United States Patent [19]

Young

[11] 4,419,195

[45] Dec. 6, 1983

[54] ELECTROLYTIC RECOVERY OF COBALT OXO CATALYSTS

[75] Inventor: David A. Young, Baton Rouge, La.

[73] Assignee: Exxon Research & Engineering Co., Florham Park, N.J.

[21] Appl. No.: 337,593

[22] Filed: Jan. 7, 1982

[51] Int. Cl.[3] ..... C25B 3/02

[52] U.S. Cl. ..... 204/78; 204/79; 204/82; 204/86

[58] Field of Search ..... 204/78, 79, 82, 86

[56] References Cited

U.S. PATENT DOCUMENTS

| | | | |
|---|---|---|---|
| 2,476,263 | 7/1949 | McKeever | 23/203 |
| 2,751,403 | 12/1952 | Mertzweiller | 260/414 |
| 3,147,203 | 9/1964 | Klass | 204/78 |
| 3,265,468 | 4/1963 | Farkas et al. | 23/203 |
| 3,793,437 | 9/1971 | Takasu et al. | 423/417 |
| 3,941,848 | 7/1973 | Kummer et al. | 260/604 |
| 4,225,458 | 9/1980 | Huang | 252/413 |
| 4,255,279 | 7/1979 | Spohn et al. | 252/413 |

FOREIGN PATENT DOCUMENTS

| | | |
|---|---|---|
| 48-17594 | 5/1973 | Japan . |
| 702221 | 8/1948 | United Kingdom . |
| 1383658 | 2/1971 | United Kingdom . |
| 1390398 | 8/1971 | United Kingdom . |
| 2067914A | 1/1980 | United Kingdom . |

OTHER PUBLICATIONS

W. Hieber and W. Hubel, *Zeitschr. Elektrochem.,* 57, No. 4, pp. 235–243, (1953), (English translation).

W. Hieber and W. Hubel, *Z. Naturforsch.,* 7b, 323–324, (1952), (English translation).

R. Kummer, et al., "New Hydroformylation Technology with Cobalt Carbonyls" *Homogeneous Catalysts–II,* Advances in Chemistry Series No. 132 (D. Forster et al.), pp. 19–26, (ACS 1973).

R. B. King, *Organometallic Synthesis,* vol. 1, p. 98, (Academic Press, 1965).

69 Chem. Abs. 95964d, (1968), citing German Patent 1,272,911.

International Critical Tables, vol. 2, pp. 172–190, (McGraw–Hill, 1927).

U.S. Serial No. 333,693, filed Dec. 23, 1981, U.S. Patent Office.

U.S. Serial No. 333,734, filed Dec. 23, 1981, U.S. Patent Office.

*Primary Examiner*—T. Tung

*Attorney, Agent, or Firm*—Jack B. Murray, Jr.

[57] ABSTRACT

According to one embodiment of the improved process of this invention, dicobalt octacarbonyl is produced in liquid medium by subjecting an aqueous solution of a tetracarbonylcobaltate salt in the presence of a solvent for dicobalt octacarbonyl to an externally applied voltage and electrical current at a magnitude and for a time sufficient to convert at least a portion of the tetracarbonylcobaltate anion to dicobalt octacarbonyl which is efficiently extracted into said solvent, thereby producing a solvent phase which can be recovered and passed to a cobalt-catalyzed olefin hydroformylation reaction zone as the source of at least a portion of the catalyst and olefin required in the olefin hydroformylation reaction to form the corresponding aldehydes. It has been surprisingly found that such a two-phase electrolysis can be performed to efficiently provide high yields of dicobalt octacarbonyl while substantially avoiding the fouling problems associated with aqueous-phase electrolysis.

14 Claims, 3 Drawing Figures

ELECTROLYTIC RECOVERY OF COBALT OXO CATALYSTS

BACKGROUND OF THE INVENTION

1. Field of the Invention

This invention in general relates to a process for recovering cobalt catalysts, and more specifically to an improved electrolytic process for recovering and recycling cobalt oxo catalysts.

2. Description of the Prior Art

In the well known oxo process, olefins are hydroformylated by reaction with carbon monoxide and hydrogen, generally charged as syn gas mixtures, in the presence of a cobalt oxo catalyst in dissolved form to form a mixture of oxo aldehydes and alcohols. This oxo reaction is typically carried out at syn gas pressures of from about 1500 to 4500 psig and at temperatures of from about 65° to 230° C. Thereafter, the product mixture containing the alcohols and aldehydes is recovered and can then be treated by known means to hydrogenate the aldehydes to form additional quantities of the corresponding alcohols. These alcohols, in turn, are widely used as chemical intermediates in the manufacture of plasticizers, detergents, solvents and the like.

Prior to the hydrogenation step, the crude oxo reaction effluent, which contains dissolved cobalt catalysts, the aldehyde and alcohol products and reaction by-products together with any metallic contaminants, is generally treated to remove the dissolved cobalt catalyst, which then for reasons of economy must be recycled to the oxo reactor.

A wide variety of catalysts recovery/recycle processes have therefore been developed. In co-pending applications "Improved Process for Recovery of Cobalt Catalysts" Ser. No. 333,734, filed Dec. 23, 1981 and "Improved Oxidative Recovery of Cobalt Oxo Catalysts" Ser. No. 333,693 filed Dec. 23, 1981 processes are disclosed in which aqueous solutions of a tetracarbonylcobaltate metal salt as contacted with an oxygen containing gas, optionally in the presence of gaseous carbon monoxide and optionally also in the presence of an organic solvent for dicobalt octacarbonyl or in the presence of an olefinic extractant for dicobalt octacarbonyl, to oxidize the tetracarbonylcobaltate anion to dicobalt octacarbonyl which is then recovered in liquid phase. An organic phase containing the dicobalt octacarbonyl can be recycled to olefin hydroformylation zone to provide at least a portion of the catalyst feed thereto. The discussion of other prior art processes for removal and recycle of cobalt catalysts from crude oxo product effluent in each of the above-referenced applications, Ser. Nos. 333,693 and 333,734, both filed Dec. 23, 1983, is hereby incorporated by reference.

The electro-potential of $Co(CO)_4H$ in glacial acetic acid has been determined by W. Hieber and W. Hübel, *Zeitchr. Elektrochem.*, 57, No. 4, pp. 235–243 (1953). The oxidation-reduction potential of the system $$2[Co(CO)_4]^- \rightleftarrows [Co(CO)_4]_2 + 2e^-$$

has also been determined by W. Hieber and W. Hübel, *Z. Naturforsch.* 7b, 323–324 (1952) to be $E_o = -0.4$ V, at 20° C. as measured on a platinum electrode (against calomel) and referred to a normal hydrogen electrode.

SUMMARY OF THE INVENTION

According to one embodiment of the improved process of this invention, dicobalt octacarbonyl is produced in liquid medium by subjecting an aqueous solution of a tetracarbonylcobaltate salt in the presence of a solvent for dicobalt octacarbonyl to an externally applied voltage and electrical current at a magnitude and for a time sufficient to convert at least a portion of the tetracarbonylcobaltate anion to dicobalt octacarbonyl which is efficiently extracted into said solvent, thereby producing a solvent phase which can be recovered and passed to a cobalt-catalyzed olefin hydroformylation reaction zone as the source of at least a portion of the catalyst and olefin required in the olefin hydroformylation reaction to form the corresponding aldehydes. It has been surprisingly found that such a two-phase electrolysis can be performed to efficiently provide high yields of dicobalt octacarbonyl while substantially avoiding the fouling problems associated with aqueous-phase electrolysis.

According to the improved process of this invention, crude oxo products produced by the cobalt-catalyzed hydroformylation of olefins and containing dissolved cobalt catalyst together with hydroformylation products are contacted in a low pressure extraction zone with an aqueous solution of a $Co^{++}$ salt of an organic or inorganic acid to form an aqueous phase containing water-soluble cobalt values, i.e., $Co^{++}[Co(CO)_4^-]_2$ and $Co^{++}$ salts of said acid, and a treated oxo product depleted in dissolved cobalt values. The aqueous phase thus obtained is then introduced into an electrolysis zone wherein the aqueous phase, in the presence of an organic solvent for dicobalt octacarbonyl, is subjected to an externally applied voltage and electrical current at a magnitude and for a time sufficient to convert at least a portion of the cobaltous bis-tetracarbonylcobaltate dissolved therein to dicobalt octacarbonyl.

In accordance with yet further embodiments, the foregoing aqueous solutions of $Co[Co(CO)_4]_2$ and the $Co^{++}$ acid salt, prior to introduction into the electrolysis zone, are contacted at elevated temperatures and pressures with $H_2$ and CO gas in a preforming zone to form additional amounts of $Co[Co(CO)_4]_2$ from the $Co^{++}$ acid salt, thereby further increasing the efficiency of the cobalt recovery process.

DETAILED DESCRIPTION OF THE INVENTION

Figure 1:
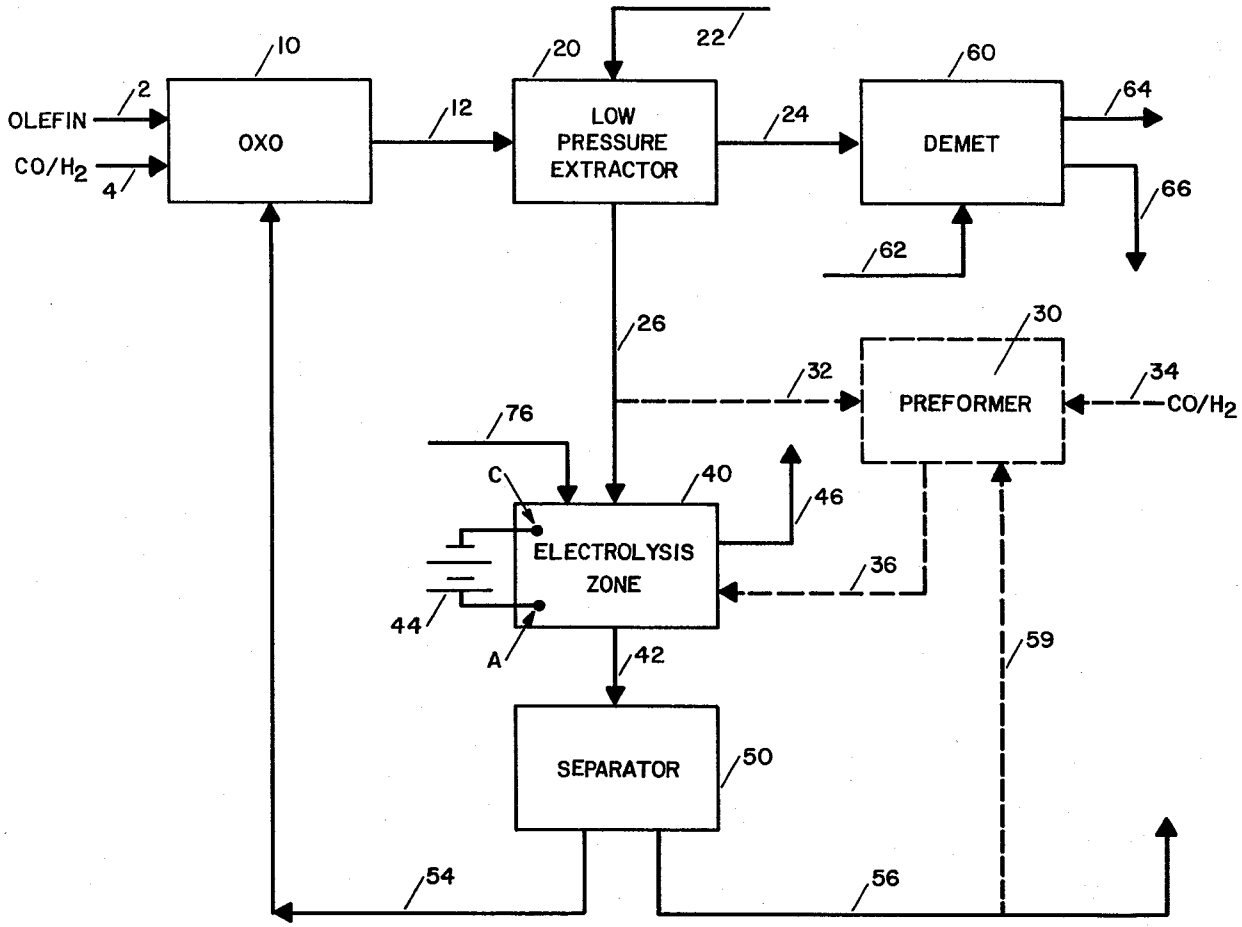
FIG. 1 is a diagrammatic illustration of one embodiment of the process of this invention.

According to one embodiment of this invention, an aqueous solution of a tetracarbonylcobaltate salt is subjected to electrolysis in an electrolysis zone in the presence of a free organic or inorganic, water-soluble acid and in the presence of a solvent liquid for $Co_2(CO)_8$ to form an organic phase containing dicobalt octacarbonyl and an aqueous phase substantially free of $Co_2(CO)_8$.

The tetracarbonylcobaltate salt in the aqueous phase can be represented in its dissociated form as $M^{+n}[Co(CO)_4^-]_n$, wherein "M" is a cation and "n" is an integer corresponding to the valence of "M". Thus, "M" can comprise a member selected from the group consisting of Co, alkali and alkaline earth metal, Fe, Cu, Mo, Ni, Al, Zn, $NH_4^+$, $H_3NR^+$, $H_2NR_2^+$, $HNR_3^+$, $NR_4^+$, and $PR_4^+$ wherein "R" is alkyl of 1 to 20 carbon atoms, aryl of 6 to 18 carbon atoms, alkaryl and aralkyl of 7 to 18 carbon atoms, and heterocyclic derivatives of the above aromatic groups. Exemplary tetracarbonylcobaltate metal salts, therefore, are $NaCo(CO)_4$, $Co[Co(CO)_4]_2$, $KCo(CO)_4$, $Mg[Co(CO)_4]_2$, $Al[Co(CO)_4]_3$, $Cu[Co(CO)_4]_2$, and the like of which $Co[Co(CO)_4]_2$ is especially preferred.

Suitable organic or inorganic acids in the aqueous phase fed to the electrolysis will be water soluble in an amount of at least about 0.04 gram per gram of water at 25° C. Illustrative of suitable organic or inorganic acids are monocarboxylic acids having from 1 to 4 carbon atoms per molecule (which are preferred), dicarboxylic acids having from 2 to 5 carbon atoms per molecule, and the like. Exemplary of such acids, therefore, are alkanoic acids such as formic, acetic, propionic, butyric, isobutyric, propionic, oxalic, malonic, succinic, and the like. The quantity of acid charged to the electrolysis zone can vary but is preferably from about 1 to 50, and more preferably 2 to 25, times the moles stoichiometrically required to react with the quantity of the tetracarbonylcobaltate salt introduced to the electrolysis zone.

The aqueous feed to the electrolysis zone will generally contain the tetracarbonylcobaltate salt in a concentration of from about 0.5 to 25 wt. %, preferably from about 1 to 10 wt. %, cobalt in the form of $Co(CO)_4^-$, and the selected inorganic or organic acid in a concentration of from about 0.2 to 10 wt. %. However, these concentration ranges are not critical and can vary widely.

The organic solvent charged to the electrolysis zone can be an olefinic or non-olefinic liquid and may be selected from U.O.P. olefins (defined in U.S. Pat. No. 4,078,132), the feed olefins (e.g., a portion, such as 10%, of the olefin feed to the subsequent hydroformylation reactor), hydroformylation product from any stage, the heavy oxygenated fraction (HOF) bottoms from the distillation of demetalled oxo alcohol product, or other suitable solvents alone or in combination. Other illustrative suitable organic solvents are those which are inert to the dicobalt octacarbonyl and which do not interfere with the desired hydroformylation reaction on recycle to oxo reactor, including for example saturated hydrocarbons, aromatic hydrocarbons, acetals, ethers, esters and mixtures comprising two or more of these solvents. Saturated hydrocarbons include, for example, methane, ethane, propane, butane, pentane, hexane, heptane, octane, nonane, decane, gasoline, cyclopentane, cyclohexane and decaline; aromatic hydrocarbons include, for example, benzene, toluene, xylene, tetraline, naphthalene and methylnaphthalene; acetals include, for example, reaction products between the aldehydes and alcohols formed in the hydroformylation such as the bis-butyl acetal of butyraldehyde, bis-decyl acetal of decanal and the like; ethers include, for example, diethyl ether, di-i-propylether, di-n-butylether, di-i-butylether, ethylene glycol dimethyl ether and ethylene glycol diethyl ether; and esters include, for example, methyl acetate, ethyl formate, propyl acetate and butyl acetate. Therefore, the organic solvent can comprise a member selected from the group consisting of olefins containing from 6 to 12 carbon atoms, and aryl-substituted alpha-olefins.

The liquid solvent for $Co_2(CO)_8$ is preferably used in an amount of from about 0.1 to 10 volumes per volume of aqueous feed introduced to the electrolysis zone.

The aqueous feed to the electrolysis zone can also contain water-soluble metal salts of any of the above inorganic or organic acids, in which the salt's cation can comprise any of the above "M" cations and preferably corresponds to the metal cation associated with the tetracarbonylcobaltate metal salt. The concentration of these inorganic or organic metal salts is not critical and will vary depending on the precise metal cation, the acid anion, and other factors. For example, $Co^{++}$ salts of such organic and inorganic acids, when present, will generally be in a concentration of from about 0.5 to 4.0 wt. %, calculated as elemental cobalt, based on the amount of water in the electrolysis zone.

The source of the aqueous solution containing the tetracarbonylcobaltate metal salt and free acid is not critical. A preferred aqueous stream for electrolysis in accordance with this invention is the aqueous effluent from a low pressure extraction of crude olefin-hydroformylation reaction products, as will be described in more detail below. The electrolysis can be performed in a continuous semi-continuous or batch-wise manner, with the components being introduced thereto separately or in any admixture. The temperature employed in the electrolysis zone can range from about 0° to 100° C., and preferably from about 20° to 60° C. Pressures are not critical and can vary from about 0 to 4500 psig, more preferably from about 15 to 1500 psig, most preferably at atmospheric pressure. Temperatures and pressures outside these ranges can also be used. The atmosphere used in the electrolysis zone is not critical and can comprise, e.g., syn gas ($CO+H_2$), CO, $N_2$ or inert gases. Atmospheric air is entirely suitable for the electrolysis. The residence time of the aqueous mixture in the electrolysis zone can also vary widely, and will generally range from about 10 seconds to 2 hours, and preferably from about 0.5 to 30 minutes.

The effluent from the electrolysis zone comprises organic and aqueous phases which can be separated and recovered using conventional equipment and techniques. The aqueous phase is depleted in carbonylcobaltate values and is substantially free of $Co_2(CO)_8$. The olefinic phase, will typically contain from about 0.5 to 15 wt.%, preferably from about 1 to 11 wt.% Co in the form of dissolved $Co_2(CO)_8$. The recovered organic phase is therefore suitable as feed to a cobalt-catalyzed olefin hydroformylation reaction to supply at least a portion of the homogeneous cobalt catalyst required therein.

Reference is now made to the accompanying drawings, wherein like numerals refer to the same or similar elements. Referring first to FIG. 1, an olefin feed is introduced via conduit 2 to oxo reactor 10 to which is also fed a mixture of CO and $H_2$ (synthesis gas) via conduit 4 and an organic liquid containing dissolved cobalt catalyst via conduit 54. The oxo reaction is conventional and typically employs a temperature of from about 150° to 450° F. and syn gas pressures of from about 1500 to 4500 psig.

The olefin fed to the oxo reactor 10 can comprise any carbon compound containing olefinic linkages. Amenable to the reaction are long and short chained olefinic compounds, depending upon the type aldehydes desired. Not only olefins, but most organic compounds possessing at least one nonaromatic carbon-carbon double bond may be reacted by this method. Thus, straight and branch-chained olefins and diolefins such as propylene, butylene, pentene, hexene, heptene, butadiene, pentadiene, styrene, olefin polymers such as di- and tri-isobutylene and hexene and heptene dimers, polypropylene, olefinic fractions from the hydrocarbon synthesis process, steam cracking or catalytic cracking operations, and other sources of hydrocarbon fractions containing olefins may be used as starting material, depending upon the nature of the final product desired. Also suitable are olefins bearing functional groups such as —C≡N, —OH, -halide and the like which do not adversely affect the hydroformylation reaction. Illustrative of such functionally substituted olefins are acrylonitrile, alkyl alcohol, alkenyl esters of acrylic acid, acrylic acid, vinyl halides and the like. Preferred are olefins having from 2 to 20 carbon atoms (such as ethylene, propylene, butenes, pentenes, hexenes, heptenes, octenes, decenes, dodecenes and the like), and aryl-substituted alpha-olefins (such as styrene, stilbene, divinylbenzenes and the like).

Crude oxo product is withdrawn from oxo reactor 10 via conduit 12 and comprises dissolved cobalt catalyst, unreacted olefin, hydroformylation product and hydroformylation by-products. The dissolved catalyst species in the oxo reactor, and hence in the crude oxo products, is considered to be hydrido cobalt tetracarbonyl, $HCo(CO)_4$, which is in equilibrium with hydrido cobalt tricarbonyl, $HCo(CO)_3$, according to "Organic Synthesis via Metal Carbonyls," Wender and Pino, Inter Science Publishers, volume I, pages249–251. The crude oxo product will generally contain cobalt in an amount of from about .05 to 3.0 wt%, calculated as elemental cobalt. The concentration of aldehyde in the crude oxo product is not critical but will generally vary from about 40 to 75 wt%.

The crude oxo product is introduced via conduit 12 into first extraction zone 2 wherein the crude oxo product is contacted with an aqueous solution containing a $Co^{++}$ salt of an organic or inorganic acid to form a treated oxo product depeleted in dissolved cobalt values and an aqueous phase containing $Co^{++}[Co(CO)_4^-]_2$ together with an excess $Co^{++}$ salt of said acid. While the conditions employed in this first extraction zone 20 can vary widely, the extraction will generally be performed at a temperature within the range of from about 10° to 95° C., and preferably from 50° to 90° C., and at a pressure of from about atmospheric to about 200 psig, preferably from about 20 to 100 psig. The organic or inorganic acid which forms the anion of the $Co^{++}$ salt introduced via conduit 22 can comprise any organic or inorganic acid the cobalt salt of which is water soluble in an amount of at least about 0.04 gram per gram of water at 25° C. Illustrative of suitable organic or inorganic acids are monocarboxylic acids having from 1 to 4 carbon atoms per molecule, dicarboxylic acid having from 2 to 5 carbon atoms per molecule, and the like. Thus, illustrative of suitable cobalt salts are cobaltous acetate, formate, propionate, butyrate and isobutyrate, and cobaltous oxalate, malonate, succinate and glutarate and mixtures of the above. The concentration of the $Co^{++}$ salt of said organic or inorganic acid in the aqueous medium introduced via conduit 22 is not critical but will generally range from about 0.5 to 4.0 wt. %, calculated as elemental cobalt. The quantity of said aqueous extractant which is introduced via conduit 22 can also vary widely, and the aqueous extractant will generally be used in an amount of from about 0.005 to 0.5, and preferably from about 0.02 to 0.16, volume of said aqueous extractant per volume of crude oxo product introduced via conduit 12.

Preferably, the crude oxo product is extracted in zone 20 in the presence of an inert gas such as nitrogen or synthesis gas (i.e., any mixture of CO and $H_2$). When the extraction in low pressure extractor 20 is performed in the presence of synthesis gas, the synthesis gas preferably has a composition of from about 40 to 60 vol % CO and from about 40 to 60 vol % $H_2$.

The extraction of the crude oxo product in zone 20 is preferably conducted for a time sufficient to extract a major amount, i.e., more than $\frac{1}{2}$, and preferably at least about 90%, of the cobalt values dissolved in the crude oxo product, calculated as elemental cobalt.

Following the treatment in extraction zone 20, the aqueous and organic phases thus obtained are separated as by settling employing conventional equipment. The organic phase comprises the treated oxo product depleted in dissolved cobalt values and now contains, e.g., up to about $\frac{1}{3}$ of the original amount of cobalt. This treated oxo product can be passed via conduit 24 into demetalling zone 60 wherein it is contacted at a temperature of from about 35° to 95° C. with oxygen or air, acetic acid or other suitable acid and water which is introduced thereto via conduit 62, thereby converting the remaining cobalt values into the aqueous soluble cobaltous salt of the acid, e.g., cobaltous acetate. The organic and inorganic acid suitable for use in demetalling zone 60 can comprise any of the organic or inorganic acids which are useful (as described above) in the aqueous extractants introduced to zone 20 via conduit 22.

From demetalling zone 60 there are withdrawn organic and aqueous phase, obtained as by settling, employing conventional equipment. The organic phase which is withdrawn via conduit 64 comprises the oxo product substantially free of dissolved cobalt values and generally less than about 10 ppm Co. The aqueous phase withdrawn from demetalling zone 60 via conduit 66 comprises an aqueous mixture containing the dissolved cobaltous salt and can be passed (after addition of make-up cobaltous acid salt, if needed) to conduit 22 as the aqueous extractant medium fed to first extraction zone 20. The make-up cobalt may be needed because some thermal degradation of the hydridocobalt tetracarbonyl may occur in the process since it does not operate at 100% efficiency. Depending on operating conditions in oxo reactor 10, the amount of make-up that must be added from an outside source typically ranges from 0 to 10 wt.% of the total cobalt employed. THe addition of the water-soluble cobaltous acid salt is a simple and convenient way of accomplishing the required make-up of cobalt values.

The aqueous phase withdrawn from low pressure extraction zone 20 via conduit 26 comprises an aqueous solution containing $Co[Co(CO)_4]_2$, and any excess cobaltous salt of the selected acid, e.g., cobalt acetate, in addition to free acid, e.g., acetic acid. This solution is introduced via conduit 26 into electrolysis zone 40, which can comprise any conventional electrolytic cell or cells arranged, e.g., in parallel or series. Zone 40 is provided with electrodes, illustrated as anode "A" and cathode "C", which are suitably connected to a source of externally applied direct current voltage, indicated at 44. Voltage source 44 is any conventional device useful in electrolysis of liquids, and a description of its structure and operation is not necessary to a complete understanding of the process of this invention.

In zone 40, the $Co[Co(CO)_4]_2$, believed to be dissolved as dissociated $Co^{++}$ and $[Co(CO)_4]^-$ ions, is electrolytically converted to $Co_2(CO)_8$ under controlled conditions in the presence of a liquid solvent for the $Co_2(CO)_8$ which is introduced thereto via conduit 76. While not desiring to be limited thereby, it is believed the following reactions occur in zone 40:

at anode "A"

$$2[Co(CO)_4]^- \longrightarrow Co_2(CO)_8 + 2e^- \quad \text{(II)}$$

at cathode "C"

$$2H^+ + 2e^- \longrightarrow H_2\,(gas) \quad \text{(III)}$$

The overall electrolysis reaction in zone 40 can therefore be illustrated as follows, using acetic acid as the acid component of the aqueous solution introduced thereto via conduit 26:

$$Co[Co(CO)_4]_2 + 2CH_3CO_2H \rightarrow Co[O_2CCH_3]_2 + Co_2(CO)_8 + H_2 \quad \text{(IV)}$$

Generally, the electrolysis in zone 40 is effected at a current density of from about 10 to 500, and preferably from about 35 to 100, milliamps/cm$^2$. The temperature and total pressure is not critical and need only be sufficient to maintain the electrolyzed liquid in the liquid phase. Thus, temperatures of from about 20° to 60° C., and pressures from about 0 to 4500 psig will be generally employed, although higher and lower temperatures and pressures are also suitable. For most efficient electrolysis, it is preferred that the organic or inorganic acid introduced to zone 40 via the aqueous solution in conduit 26 be present in an amount of at least about 1 mol, preferably at least about 50 mols, and more preferably from about 2 to 25 mol of the acid per mol of $Co(CO)_4^-$ introduced via conduit 26. The residence time of the aqueous mixture in oxidation zone 40 can also vary widely, and will generally comprise from about 10 seconds to 2 hours, and preferably from about 0.5 to 30 minutes.

Free organic or inorganic acid should be present in zone 40 throughout the electrolysis. The acid concentration can vary widely, and will generally range from about 0.1 to 20 wt. % in the case of lower alkanoic acids, (e.g., acetic, formic, propionic, and butyric acids). Generally, sufficient acid will be present in the aqueous feed introduced via conduit 26. Additional acid may be passed directly into zone 40 if required via a separate conduit (not shown). Any of the above-described acids whose cobaltous salts are useful in the aqueous extractant fed via conduit 22 to low pressure extractor 20 are also suitable for use in the electrolysis zone. Typically, the acid will correspond to the cobaltous acid salt used in the first extraction step 20. Exemplary of such acids, therefore, are alkanoic acids such as formic, acetic, propionic, butyric, isobutyric, propionic and the like.

The gaseous hydrogen formed in zone 40 is removed via conduit 46 and can be recycled, if desired, to oxo reactors 10, or employed in the hydrogenation of the demetalled oxo product to produce the corresponding alcohols therefrom.

A mixture of the resulting organic and aqueous phases formed in the zone 40 is withdrawn from electrolysis zone 40 via conduit 42 and passed to separation zone 50 for separation of the organic and aqueous phases. Separation zone 50 can employ conventional separation equipment and techniques. From separation zone 50 there is withdrawn an organic phase containing dissolved dicobalt octacarbonyl via conduit 54 which can be recycled to oxo reactor 10. The organic phase can also contain other cobalt carbonyls and complexes, such as $Co_4(CO)_{12}$, $\pi$-olefin cobalt tetracarbonyl and tricarbonyl complexes, and alkyl and acyl-cobalt tetracarbonyls and tricarbonyls wherein the foregoing olefin, alkyl and acyl groups are derived from any olefin fed to electrolysis zone 40. While the precise composition of the organic phase will vary widely depending on the conditions of electrolysis (e.g., the solvent, temperature, amp hr., liquid residence time, and the like) used in zone 40, the composition of the aqueous feed to zone 40 and other factors, this phase will generally contain from about 0.5 to 15 wt. %, and preferably from about 1 to 11 wt. %, Co in the form of dissolved $Co_2(CO)_8$. The aqueous phase withdrawn from separator 50 via conduit 56 will be preferably substantially free of $Co_2(CO)_8$ and will generally contain from about 0.2 to 10 wt. % $Co^{++}$ salt of the free acid present in zone 40 (e.g., cobaltous acetate), in addition to this free acid itself, generally in amounts of less than 10 wt. %.

It will be understood that the aqueous solution containing cobaltous acid salt withdrawn via conduit 56, as well as the aqueous solution withdrawn from demetalling zone 60 via conduit 66, can be passed to a suitable storage vessel (not shown) which can serve as intermediate storage of the aqueous extractant ultimately intended for passage via conduit 22 to the low pressure extraction zone 20. It should be noted that there is no discarding of the circulating stream, which both conserves cobalt and avoids waste disposal problems. However, if excess water accumulates, it can be removed by withdrawing a sidestream (not shown) from such storage vessel, which sidestream can then be treated to evaporate a portion of the water therefrom and to return the thus-concentrated stream to the storage vessel.

In order to provide further improved efficiency of the process, at least a portion, or all, of the aqueous solution withdrawn from low pressure extraction zone 20 via conduit 26 can be passed via conduit 32 to preforming zone 30 to which synthesis gas is supplied via conduit 34. (The synthesis gas composition is not critical but will generally contain from about 40 to 60 vol. % CO and from about 60 to 40 vol. % $H_2$.) In zone 30, the aqueous solution is treated at a temperature of from about 0° to 200° C. and at a synthesis gas pressure of from 1500 to 4500 psig. Additional quantities of $Co[Co(CO)_4]_2$ are formed therein from the excess cobaltous acid salt introduced thereto via conduit 26. While we do not wish to be bound by any theory, it is believed the preforming reaction can be illustrated by the following equation (V):

$$3Co(OAc)_2 + 3H_2 + 8CO \xrightarrow{Co[Co(CO)_4]_2} Co[Co(CO)_4]_2 + 6\,HOAc \quad \text{(V)}$$

The $Co[Co(CO)_4]_2$ in the aqueous feed to preformer 30 acts as a homogeneous catalyst for the conversion of the cobaltous salt. A maximum of about 67% of the total cobalt in the solution can exist in the carbonyl form at the conclusion of the preforming step, as shown by Equation V.

The preformer 30 can also employ a heterogeneous catalyst such as activated charcoal, zeolites, basic ion exchange resins, or the like. Suitable types of activated carbon are for example peat carbon, animal charcoal or charcoal derived from sugar. Preferred basic ion exchange resins are those which contain primary, secondary or tertiary amino groups. Ion exchange resins based on polystyrene which contain tertiary amino groups or quaternary amino groups in the basic form are especially suitable, exemplary of which are Amberlite IR45 and Dowex 4. Also suitable are macroreticular types such as Amberlyst A 21, Lewatit MP 62, Lewatit MP 64, Imac A 20, Cerolit G, Amberlite IRA 93, and Amberlist A 26. The activated carbon, zeolite or basic ion exchange resin is preferably loaded with cobalt carbonyl until it is saturated. This is generally achieved by passing aqueous solutions of cobalt salts together with the said gas mixture of carbon monoxide and hydrogen over the activated carbon, zeolite, or basic ion exchange resin under the specified reaction conditions until they are saturated, that is until cobalt carbonyl or cobalt carbonyl hydride is detected analytically in the discharge.

The low pressure extraction in zone 20, the preforming step and the demetalling oxidation of zone 60 are more completely described in U.S. Pat. No. 4,255,279, which is hereby incorporated by reference.

In the event that excess $Co^{++}$ values are present in the aqueous phase withdrawn via conduit 56 from the separator 50, at least a portion of this aqueous phase can be passed to preformer 30 via conduit 59 in order to preform additional $Co(CO)_4^-$ values therein from the excess $Co^{++}$, thereby increasing the overall yields and conversions of $Co_2(CO)_8$.

By means of the embodiment discussed above, the need for a separate catalyst plant, viz., for manufacturing cobaltous oleate in which expensive oleic acid and caustic are required on a once-through basis, and which may be a bottleneck in the oxo process, is avoided. These embodiments not only achieve efficient demetalling of crude oxo product, but also extract and preserve active catalyst in the oxo product which is then used as catalyst in a preforming step so that there is no difficulty or induction period in achieving preforming as when the starting point is an inactive cobaltous salt. Furthermore, any make-up cobalt needed in these embodiments can still be supplied without resort to the manufacture of cobalt soap simply by introducing the required amount of a cobaltous salt of an organic or inorganic acid and processing it along with other similar material. Additionally, these embodiments operate on a closed cycle, with no by-products other than water being discharged from the system, so that there are no costs due to environmental protection systems and no adverse effect on the environment. Finally, corrosion concerns associated with any catalyst cycle in which an aqueous cobalt solution is directly injected into the oxo reactors, are eliminated.

If desired, the electrolytic recovery process of this invention can be integrated with a cobalt soap process. Thus, according to yet further embodiments, at least a portion of the aqueous phase containing dissolved $Co^{++}$ acid salts recovered from the electrolysis zone of the process of this invention, can be passed to a separate contacting zone wherein it is contacted with a source of higher molecular weight fatty acid anions and an organic solvent therefor to form the corresponding cobaltous salt of the higher fatty acid. These higher fatty acid cobaltous salts are substantially water-insoluble and are soluble in the organic solvent, thus forming an aqueous phase depleted of cobalt values and an organic phase containing the cobaltous higher fatty acid salts ("cobalt soap") which can be recycled to the hydroformylation to provide additional catalyst therein. In another embodiment, the organic phase containing the $Co^{++}$ salt of said higher fatty acid is passed to the electrolysis zone as the feed of organic solvent thereto. In this embodiment, the organic extract recovered from the electrolysis zone comprises dicobalt octacarbonyl, $Co^{++}$ salt of said higher fatty acid and unreacted higher fatty acid, and can be recycled to the hydroformylation.

Figure 2:
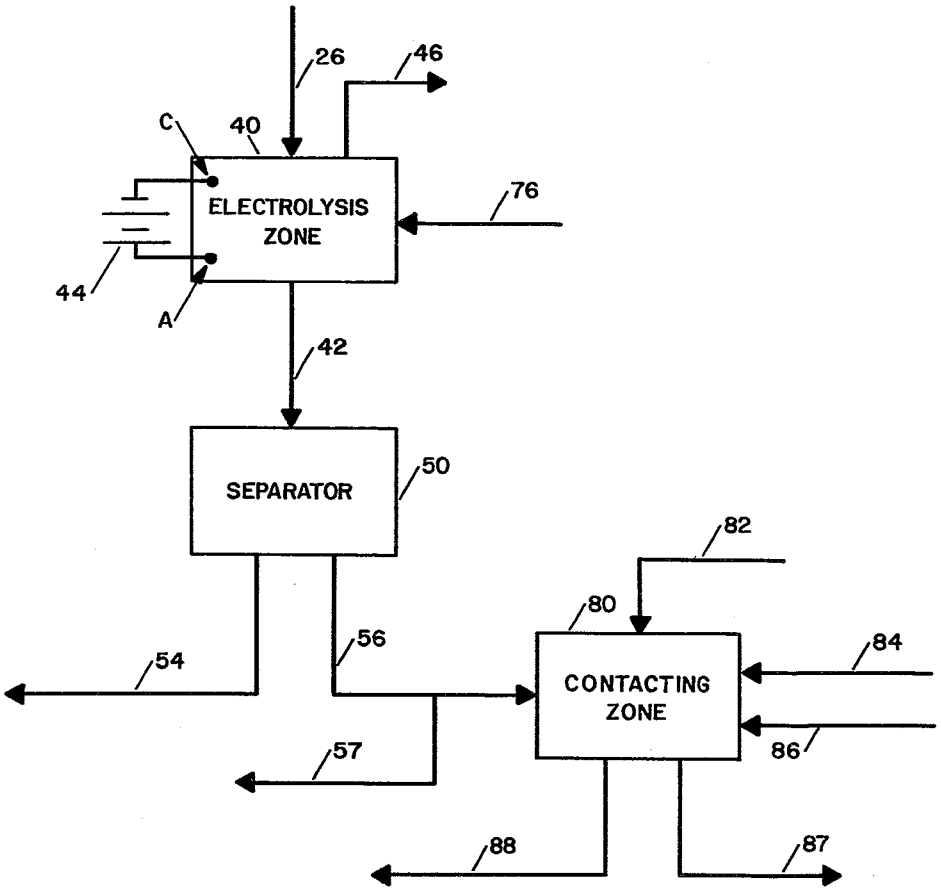
FIG. 2 is a diagrammatic illustration of a second embodiment of the process of this invention.

These additional embodiments can be illustrated by reference to FIGS. 2 and 3. In FIG. 2, as before, an aqueous phase comprising $Co[Co(CO)_4]_2$, free inorganic or organic acid (e.g., acetic acid) and any excess cobaltous salt of this acid (e.g., cobaltous acetate) is introduced via conduit 26 to electrolysis zone 40 wherein it is treated as described above to form $Co_2(CO)_8$ in the presence of a liquid solvent which is introduced thereto via conduit 76. The conditions of electrolysis and the types and quantities of feeds to zone 40 correspond to those discussed above. There is thus formed an organic phase containing $Co_2(CO)_8$ which can be recovered as discussed above in phase separator 50 and recycled via conduit 54 to the oxo reactors (not shown). The aqueous phase, comprising dissolved $Co^{++}$ values (e.g., cobaltous acetate) and substantially free of $Co_2(CO)_8$ is withdrawn from zone 50 via conduit 56 and a portion thereof can be recycled via conduit 57, if desired, to the low pressure extractor (not shown; e.g., zone 20 of FIG. 1). The balance of this aqueous stream, (generally from about 10 to 80 wt. % of the stream) is introduced via conduit 56 into contacting zone 80 wherein it is contacted with a higher molecular weight fatty acid such as oleic acid, which is introduced thereto via conduit 86, an organic solvent for the higher fatty acid which is introduced thereto via 82, and an alkaline reacting agent which is introduced thereto via conduit 84. The alkaline reacting agent, e.g. caustic, reacts with the added higher fatty acid to form the corresponding (e.g., sodium) salt which then reacts with the cobaltous values introduced via the aqueous raffinate to form the cobaltous salt of the higher fatty acid which is then extracted into the organic solvent. While not wishing to be bound thereby, it is believed the reactions in zone 80 can be illustrated by the following equation (VI), employing caustic, cobaltous acetate and oleic acid as exemplary:

$$2NaOH + Co(OAc)_2 + 2CH_3(CH_2)_7CH{=}CH(CH_2)_7CO_2H \rightarrow Co[O_2C(CH_2)_7CH{=}CH(CH_2)_7CH_3]_2 + 2NaOAc + 2H_2O \quad \text{(VI)}$$

The resulting organic and aqueous phases can be separated and recovered by conventional means. The organic "cobalt soap" is withdrawn via conduit 88 and can be recycled to the hydroformylation's oxo reactors (not shown). The aqueous phase contains the water-soluble salts (e.g., sodium acetate), and desirably is substantially free of cobalt values (less than 10 ppm dissolved cobalt); this phase can thus be withdrawn via conduit 87 and passed to waste.

The higher molecular weight fatty acids which are introduced to zone 80 can comprise fatty acids which are substantially insoluble in water, i.e., possess a water solubility of less than about 0.1 grams of acid per liter of water at 25° C. Illustrative of suitable higher fatty acids, therefore, are stearic acid, oleic acid, palmitic acid, naphthinic acid, decanoic acid, 2-ethyl-hexanoic acid and the like. Preferred higher fatty acids are oleic acid, and by-product acids recovered from hydroformylation effluent, e.g., alkanoic acids having a carbon skeleton equivalent to the product aldehydes.

The fatty acid should be introduced via conduit 86 in an amount sufficient to provide the moles of acid required to react with the moles of cobaltous cations introduced with the aqueous raffinate to zone 80. Typically, the higher fatty acid will be introduced in an amount sufficient to provide from about 2.0 to 2.2 moles of the higher fatty acid per mole of cobaltous cations thus introduced to zone 80.

The alkaline reacting agent introduced via conduit 84 can comprise any basically reacting material which will react with the selected higher fatty acid to liberate water and form the corresponding carboxylate anions of the higher fatty acid. Suitable alkaline reacting agents, therefore, include alkali and alkali earth metal hydroxides, ammonium hydroxide, aluminum hydroxide, cobaltous hydroxide and the like. Alkali metal hydroxide, essentially sodium and potassium hydroxide, are especially preferred. The quantity of such alkaline reacting agents can vary widely, but they will generally be introduced in an amount of from about 0.5 to 2.0 moles, preferably from about 0.8 to 1.4 moles, of the alkaline reacting agent per mole of the higher fatty acid which is introduced to zone 80.

The organic solvent fed to zone 80 via conduit 82 can comprise any of the organic solvents which have been mentioned above as being suitable for use in electrolysis zone 40. Preferably, the organic solvent introduced to contacting zone 80 corresponds to the organic solvent selected for use in electrolysis zone 50. Thus, especially preferred are organic solvents selected from the group consisting of U.O.P. olefins, the feed olefins employed in the hydroformylation reaction, hydroformylation product, the heavy oxygenated bottoms fraction from the distillation of the oxo alcohols formed by hydrogenation of the hydroformylation product and mixtures thereof.

The conditions of temperature and pressure which are employed in contacting zone 80 are not critical and can vary widely. Generally, a temperature from about 5° to 90° C., preferably from about 20° to 60° C., will be employed. Pressures are not critical, and pressures of from 1 to 2 atmospheres are entirely suitable.

However, temperatures and pressures outside these ranges are entirely suitable. The manner in which the aqueous raffinate, organic solvent, alkaline reacting agent and higher fatty acid are contacted in zone 80 is also not critical. Thus, these streams can be contacted in the batchwise, semi-continuous or continuous manner in any conventional equipment, e.g., a stirred reaction vessel.

The reaction time provided in contacting zone 80 can also vary widely, and will generally range from about 15 minutes to 3 hours, preferably from about 30 to 60 minutes.

In the embodiments that are illustrated in the accompanying drawings, separate introduction of the alkaline reacting agent and a higher fatty acid are shown. It will, however, be understood that the selected alkaline reacting agent and higher fatty acid can be first reacted, as for example in a separate reaction vessel, and then fed as a combined stream (not shown) to contacting zone 80.

The amount of organic solvent which is introduced to contacting zone 80 can vary widely and need only be that amount which is sufficient to dissolve the cobaltous higher fatty acid salts which are formed therein. Generally, the organic solvent is introduced in an amount of from about 1 to 100 volumes, preferably from about 10 to 50 vols, per vol. of higher fatty acid which is introduced to zone 80.

Figure 3:
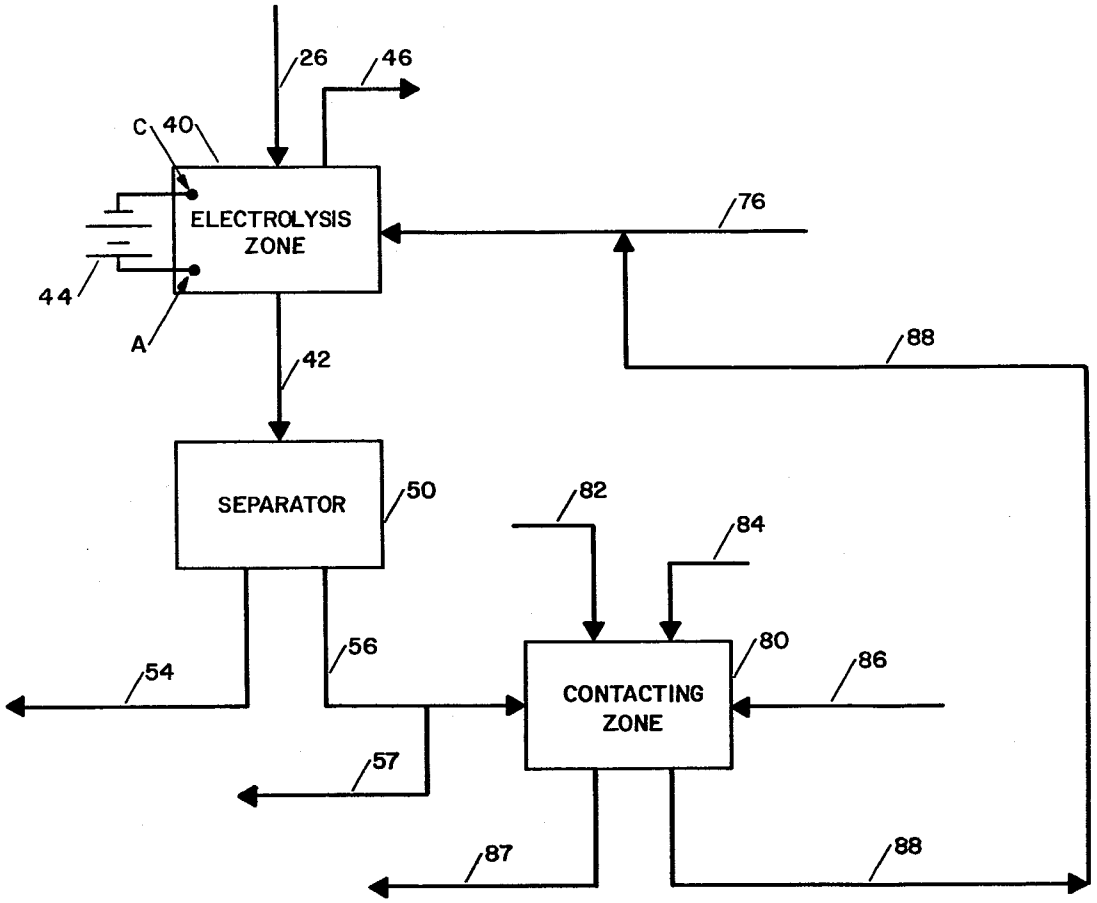
FIG. 3 is a diagrammatic illustration of a third embodiment of the process of this invention.

Referring now to the embodiment illustrated in FIG. 3, the organic phase formed in contacting zone 80 and containing the cobalt soap, is passed via conduit 88 to conduit 76 and thereby comprises at least a portion of the organic solvent which is introduced to electrolysis zone 50. Therein, the thus-recycled organic phase functions to extract dicobalt octacarbonyl values which are formed.

In this embodiment, the organic phase withdrawn from separator 50 via conduit 54 comprises a mixture of dicobalt octacarbonyl and the cobaltous higher fatty acid salt. The aqueous phase recovered from separator 50 via conduit 56 can, as has been described above, be partially recycled via conduit 57 and the remainder fed to contacting zone 80, wherein it is admixed with organic solvent, alkaline reacting agent and higher molecular weight fatty acid, as described above, to form the cobaltous higher fatty acid salt from the cobaltous water soluble salt (e.g., cobaltous acetate) present in the aqueous phase in conduit 56.

It will be understood from the above discussion that the separation effected in zone 50 and the reactions performed in zone 80 of FIGS. 2 and 3 can be effected in a single vessel, herein termed the "combined separating/contacting vessel" (not shown), to which is fed the aqueous and organic phases contained in conduit 42 for contact therein with a higher molecular weight fatty acid and an alkaline reacting agent in order to form an organic phase containing a mixture of the dicobalt octacarbonyl and the cobaltous salt of the selected higher molecular weight fatty acid, wich can then be recycled to the oxo reactors, (e.g., stream 54 in the embodiment of FIG. 2). There is also produced in this combined separating/contacting zone an aqueous stream (e.g., stream 87 in FIGS. 1 and 2) which can be recovered and is desirably substantially free of dissolved cobalt values. The temperature of the combined separating/contacting step is preferably within the range of from about 0° to 90° C., and the pressure therein is preferably from about 15 to 1500 psig.

In the use of the above combined separating/contacting zone (a modification of the embodiments of FIGS. 2 and 3), the organic solvent which is selected for use should be a solvent both for the dicobalt octacarbonyl and for the cobaltous higher fatty acid salt which is formed.

The process of this invention can be further illustrated by the following examples wherein parts are by weight unless otherwise indicated. In the Examples, analysis for $Co[Co(CO)_4]_2$ is by ethylenediamine tetracetic acid (EDTA) titration of a sample whose total cobalt is oxidized to the $Co^{+2}$ form by use of $H_2O_2$. Concentrations of $Co[Co(CO)_4]_2$ are calculated on the basis of $Co(CO)_4^-$ anion determined by analyzing the CO gas released on oxidation of the samples with an excess of potassium triiodide. $Co_2(CO)_8$ concentrations are calculated on the basis of elemental cobalt. Concentrations of cobaltous acetate are calculated on the basis of EDTA titration. Yields and conversions of $Co_2(CO)_8$ are calculated on the basis of $Co[Co(CO)_4]_2$ consumed.

EXAMPLE 1

A cylindrical (3.8 cm ID × 7.8 cm height) glass vessel, provided with a platinum anode and cathode, each having a surface area of about 40.8 $cm^2$, is flushed with $N_2$ to remove air therefrom and is then charged with 46.5 gms. of an aqueous solution containing 0.458 gms. cobalt as cobaltous bis-tetracarbonylcobaltate ($Co[Co(CO)_4]_2$ (5.18 mmols), 0.253 gms. cobalt as cobaltous acetate and 0.933 gms. of acetic acid, together with 13.2 gms. (0.105 mols) of 1-nonene. Each electrode is constructed of Pt wire mesh having an average mesh size of 1 $mm^2$. The anode comprises a cylinder having dimensions 8.0 cm in length and 5.1 cm in height and is placed inside the cathode which is semi-cylindrical in shape, and has a height of 5.1 cm. The two electrodes are separated by a distance of 6.5 cm by means of a Teflon spacer ring. The glass vessel is provided with a rubber stopper through which passes (1) 2 Pt connector wires, each attached to one of the electrodes, and (2) a glass tubing for charging gas and liquid to the electrolysis vessel. The 2 Pt connector wires are then each connected to a direct current source, a DC power supply of capacity 12 volt, 6 amp, connected to a variable AC power supply, for electrolysis of the mixture. The vessel is shaken throughout the electrolysis to allow the liquid olefin phase to periodically wash the entire electrode surface.

The voltage across the cell is adjusted periodically as set forth in Table I below, and the volume of gas released during the electrolysis is determined.

TABLE I

| Time (min.) | Voltage (v.) | Milliamps (ma) | $H_2$ Gas Released (cc) |
|---|---|---|---|
| 0 | 0.53 | 12.0 | 0 |
| 21 | 0.59 | 10.4 | 3.5 |
| 21.5 | 0.74 | 69 | 3.5 |
| 60 | 0.74 | 57 | 17.3 |
| 93 | 0.77 | 52 | 26.5 |

After 93 minutes, the electrolysis is stopped and the aqueous and olefin liquid phases are recovered, separated and analyzed. The olefinic phase is found to contain $Co_2(CO)_8$ in a yield of about 98%, based on $Co(CO)_4^-$ consumed (44%). Conversion of $Co(CO)_4^-$ to $Co_2(CO)_8$ is found to be about 43%. Conversion of $Co(CO)_4^-$ to $Co^{++}$ is found to be about 1.0%. Analysis of the separated olefin phase by gas chromatography shows no detectable amount of olefin oxidation products.

The cathode is removed and washed with nitric acid to remove a small amount of Co metal observed deposited thereon. The wash acid is found to contain 3.4% of the total initial cobalt present in the electrolysis vessel.

The amount of $H_2$ collected is found to be 92% of theory.

EXAMPLE 1A—FOR COMPARISON

Example 1 is repeated except that the 1-nonene is omitted from the charge to the glass vessel. The electrolysis is initiated and gaseous hydrogen is observed to be evolved from the aqueous solution at the cathode. The anode is observed to rapidly turn yellow as dicobalt octacarbonyl is plated out on this electrode. After a few seconds of electrolysis, current flow ceases.

It will be obvious that various changes and modifications may be made without departing from the invention and it is intended, therefore, that all matter contained in the foregoing description shall be interpreted as illustrative only and not limitative of the invention.

What is claimed is:

1. A process for forming dicobalt octacarbonyl in liquid medium, which comprises subjecting an aqueous solution containing a water-soluble tetracarbonylcobaltate salt in an electrolysis zone and in the presence of an organic solvent for dicobalt octacarbonyl to an externally applied voltage and electrical current at a magnitude and for a time sufficient to convert at least a portion of said tetracarbonylcobaltate salt to dicobalt octacarbonyl which is extracted into said organic solvent thereby forming an organic phase containing dissolved dicobalt octacarbonyl which can be recovered and is suitable for use as catalysts feed to an olefin hydroformylation reaction.

2. The process according to claim 1 wherein said electrolysis is conducted at a temperature within the range of from about 0° to 90° C.

3. The process according to claim 1 wherein said organic solvent is employed in an amount of from about 0.1 to 10 volumes per volume of said aqueous solution.

4. The process according to claim 1 wherein said tetracarbonylcobaltate salt comprises a salt having the formula:

$$M^{+n}[Co(CO)_4^-]_n,$$

wherein "M" is a cation selected from the group consisting of Co, alkali and alkaline earth metal, Fe, Cu, Mo, Ni, Al, Zn, $NH_4^+$, $H_3NR^+$, $H_2NR_2^+$, $HNR_3^+$, $NR_4^+$, and $PR_4^+$, wherein "R" is alkyl of 1 to 20 carbon atoms, aryl of 6 to 18 carbon atoms, alkaryl and aralkyl of 7 to 18 carbon atoms and heterocyclic derivatives of the foregoing aromatic groups.

5. The process according to claims 1 or 4 wherein said organic solvent comprises a member selected from the group consisting of olefins containing from 6 to 12 carbon atoms, and aryl-substituted alpha-olefins.

6. The process according to claim 1 wherein said tetracarbonylcobaltate salt comprises cobaltous bis-tetracarbonylcobaltate and wherein said electrolysis is conducted at a temperature within the range of from about 0° to 90° C.

7. A process for demetalling an oxo product contaminated with cobalt-containing catalyst residues and recovering cobalt carbonyls therefrom which comprises:

(a) treating the oxo product in a first demetalling zone with an aqueous solution of a $Co^{++}$ salt of an organic or inorganic acid to extract at least a portion of the cobalt-containing catalyst residues from the oxo product into a first aqueous phase and to form $Co[Co(CO)_4]_2$ therein;

(b) substantially completing the demetalling of the thus treated oxo product by treatment in a second demetalling zone with an aqueous organic or inorganic acid in the presence of oxygen to form a $Co^{++}$ salt of said acid; and (c) passing said first aqueous phase to an electrolysis zone in the presence of an organic solvent for $Co_2(CO)_8$ wherein it is subjected to an externally applied voltage and electrical current at a magnitude and for a time sufficient to convert at least a portion of the $Co[Co(CO)_4]_2$ to $Co_2(CO)_8$ thereby forming a second aqueous phase depleted in cobalt values, and an organic phase containing $Co_2(CO)_8$ suitable for recycle to an oxo reaction zone as catalyst.

8. The process according to claim 7 wherein the electrolysis zone employs a temperature in the range of from about 20° to about 60° C. and a pressure in the range of from about 0 to 4500 psig.

9. The process according to claim 7 wherein said second aqueous phase contains $Co^{++}$ values and at least a portion of said second aqueous phase is passed to the first demetalling zone to provide at least a portion of said aqueous solution.

10. The process according to claim 7 in which said $Co^{++}$ acid salt is cobalt acetate or cobalt formate or mixtures thereof.

11. The process according to claim 7 in which the organic solvent is a liquid olefin.

12. The process according to claim 7 wherein the first aqueous phase withdrawn from step (a) additionally contains said $Co^{++}$ acid salt and wherein at least a portion of said first aqueous phase is treated with synthesis gas at a pressure in the range of from about 1500 psig to about 4500 psig and at a temperature in the range of from about 100° to about 400° F., to form additional quantities of $Co[Co(CO)_4]_2$ from said $Co^{++}$ acid salt; and wherein the thus-treated first aqueous phase is passed to a said electrolysis zone for formation of additional quantities of $Co_2(CO)_8$ therein.

13. The process according to claim 7 wherein the second aqueous phase formed in step (c) is recovered and at least a portion thereof is contacted with an alkaline reacting agent, a higher molecular weight fatty acid, an organic solvent therefor to form an organic phase containing the corresponding cobaltous salt of said higher molecular weight fatty acid suitable for recycle to an oxo reaction zone as catalyst.

14. The process according to claim 13 wherein at least a portion of said organic phase containing the corresponding cobaltous salt of said higher molecular weight fatty acid is passed to said electrolysis zone of step (c) to provide at least a portion of said organic solvent.

* * * * *